United States Patent [19]

Sun

[11] Patent Number: 5,042,794

[45] Date of Patent: Aug. 27, 1991

[54] LOAD APPLYING DEVICE FOR AN EXERCISE BICYCLE

[75] Inventor: Paul Sun, Taichung Hsien, Taiwan

[73] Assignee: Giant Manufacturing Co., Ltd., Taichung Hsien, Taiwan

[21] Appl. No.: 488,672

[22] Filed: Mar. 2, 1990

[51] Int. Cl.[5] ..... A63B 21/00

[52] U.S. Cl. ..... 272/73; 310/94

[58] Field of Search ..... 272/69, 73, 129; 310/93, 94, 105, 154

[56] References Cited

U.S. PATENT DOCUMENTS

| | | | |
|---|---|---|---|
| 3,590,293 | 6/1971 | Susdorf | 310/154 |
| 3,624,438 | 11/1971 | Hoyler | 310/93 |
| 3,626,222 | 12/1971 | Dischler | 310/94 |
| 3,886,255 | 5/1975 | Noly | 310/94 |
| 4,713,567 | 12/1987 | Fey et al. | 310/105 |
| 4,838,544 | 6/1989 | Sasakawa et al. | 272/73 |
| 4,898,379 | 2/1990 | Shiba | 272/73 |

*Primary Examiner*—Richard J. Apley

*Assistant Examiner*—Glenn E. Richman

*Attorney, Agent, or Firm*—Ladas & Parry

[57] ABSTRACT

A device for applying a load to a rotating shaft of an exercise bicycle which receives the load. When a user places his/her feet on the pedals of the exercise bicycle and bends and stretches his/her legs, the transmission gear of a speed increasing mechanism of the exercise bicycle is rotated by the paddles and thereby, a rotor coupled by a bearing to a fixed main shaft of the load applying device is rotated with respect to the main shaft. The rotor is a magnetic conductor. A magnetic field is provided so that the rotor is passed through a beam-like magnetic flux path produced thereby. When the rotor is rotated, the rotor cuts the magnetic field and thereby produces an induced eddy current, causing an eddy current break effect to the rotor. In this way, the load applying device can apply a load to the user who rides on the exercise bicycle. A first and a second pawl-type electromagnet are respectively used as a first and a second pole thereof. The rotor is mounted between the first and second poles of the electromagnet.

3 Claims, 5 Drawing Sheets

D (%——% '$*%%$

LOAD APPLYING DEVICE FOR AN EXERCISE BICYCLE

BACKGROUND OF THE INVENTION

This invention relates to a load applying device, more particularly to a load applying device for an exercise bicycle.

Exercise bicycles are widely used for indoor exercise. A load applying device is provided with the exercise bicycle for optionally applying load during exercise for a user according to the user's physical condition.

In past, a load applying device included a weight for adjusting the load applied to the user. Recently, a programmable computerized exercise bicycle has been developed and disclosed in U.S. Pat. No. 4,790,528. A load applying device for an exercise bicycle has also been proposed and developed for applying load to a user by means of a brake effect caused by an eddy current, which was disclosed in U.S. Pat. No. 4,775,145, U.S. Pat. No. 4,800,310, and U.S. Pat. No. 4,817,938.

SUMMARY OF THE INVENTION

It is an object of this invention to provide an improved load applying device for an exercise bicycle.

A feature of this invention is to provide a device for applying a load to a rotating shaft of an exercise bicycle. A user can set a proper controlling current to control the load applied by the load applying device to exercise according to his/her physical condition. When the user places his/her feet on the pedals of the exercise bicycle and bends and stretches his/her legs, the transmission gear of a speed increasing mechanism of said exercise bicycle is rotated by said pedals and thereby, a rotor coupled by a bearing to a fixed main shaft of the load applying device of this invention is rotated with respect to said main shaft. The rotor is a magnetic conductor. A beam-like magnetic flux path produced by the magnetic field passes through the rotor. When the rotor is rotated, the rotor cuts the magnetic field and thereby produces an induced eddy current, causing an eddy current break effect to said rotor. In this way, the load applying device applies a load to the user who rides the exercise bicycle. A first and a second pawl-type electromagnet are respectively used as a first and a second pole thereof. The rotor is mounted between the first and second poles of the electromagnet.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENT

Figure 1:
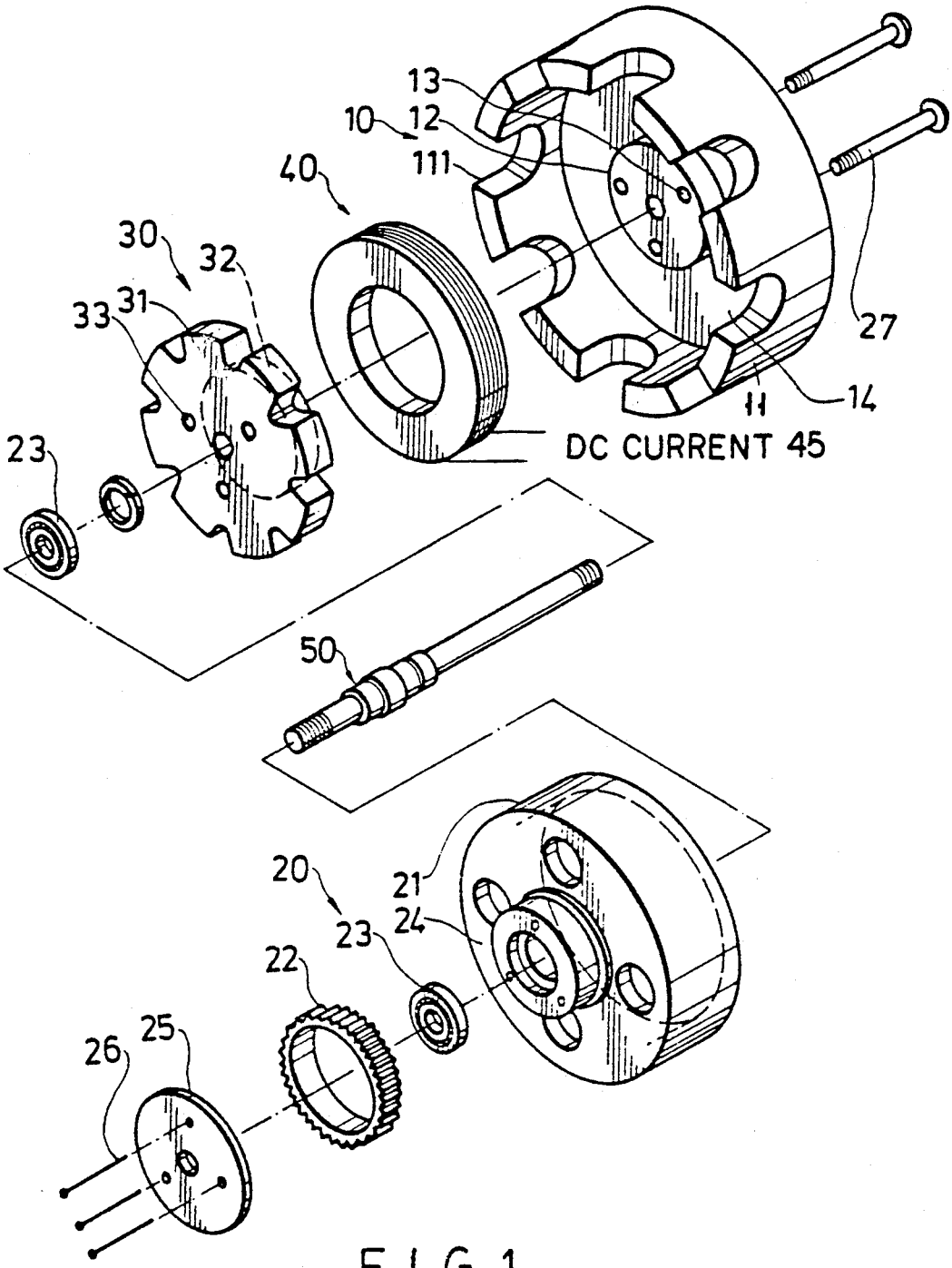
FIG. 1 is a perspective exploded view of a load applying device for an exercise bicycle of this invention.
Figure 2:
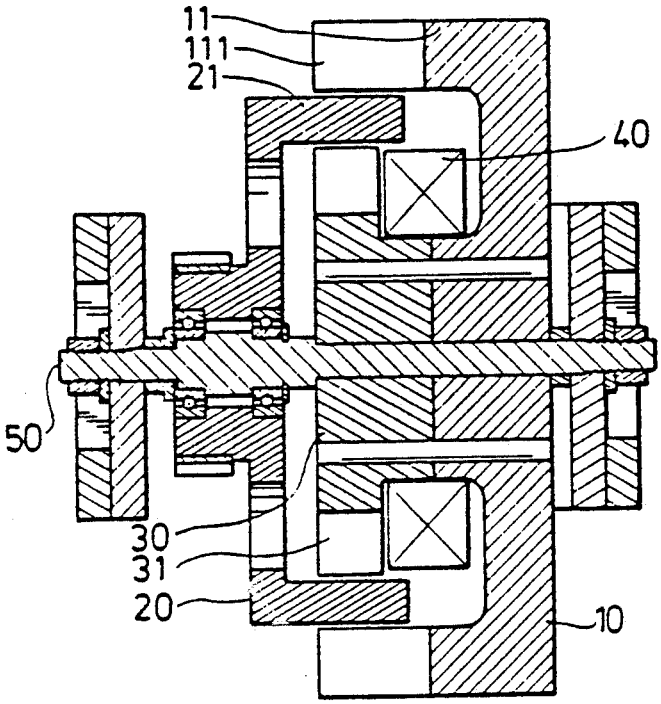
FIG. 2 is an axially sectional view of a load applying device for an exercise bicycle of this invention.

Referring to FIGS. 1, 2, a load applying device for an exercise bicycle of this invention is connected to the transmission gears of the exercise bicycle by means of a belt. The load applying device includes an electromagnet 10, a cup-shaped rotary disk 20, a pawltype magnetic conductor 30, an annularly exciting coil 40, and a fixed main shaft 50. The electromagnet 10, the magnetic conductor 30 and the exciting coil 40 are coaxially fixed to the main shaft 50, while the rotary disk 20 is rotatably mounted to the main shaft 50.

The electromagnet 10 has a cylindrical wall 11 with eight axially projecting teeth 111 extending from the circumference of a closed end 14. The projecting teeth 111 are equally spaced from each other. A cylinder 12 axially protrudes from the central portion of the closed end 14 of the electromagnet 10 so that the exciting coil 40 can be mounted to the cylinder 12. The cylinder 12 has a plurality of threaded holes 13 axially formed therethrough.

The cup-shaped rotary disk 20 is a magnetic conductor, and is rotatably coupled to the main shaft 50 by two bearings 23. The circumference of cup-shaped rotary disk 20 includes a cylindrical wall 21 axially extending from a flat bottom portion 24 thereof. The outer diameter of the cylindrical wall 21 is slightly smaller than the inner diameter of the cylindrical wall 11 of the electromagnet 10, so that said cylindrical wall 21 of said rotary disk 20 can be coaxially inserted into said cylindrical wall 11 of said electromagnet 10 but not contacted therewith. A spur gear 22 is coaxially fixed to the bottom portion 24 of the rotary disk 20 by a fixing disk 25 and three screws 26. The diameter of the fixing disk 25 is greater than the outer diameter of the spur gear 22. The spur gear 22 is connected to the transmission gear of the exercise bicycle (not shown) by a belt (not shown). Therefore, when the transmission gear is rotated by pedaling the exercise bicycle, the spur gear 22 and thereby the rotary disk 20 can be rotated. The ratio of the radius or number of teeth between the transmission gear and the spur gear 22 can be properly adjusted according to the practical operating conditions. It is noted that only the rotary disk 20 is rotated by the belt while the other components of the load applying device of this invention are not rotated thereby.

The pawl-type magnetic conductor 30 is a flat disk having eight radially projecting teeth 31 formed on the circumference and a central cylinder 32 axially protruding therefrom, which is associated with the cylinder 12 of the electromagnet 10 to form a positioning shaft, so that the annular exciting coil 40 can be threaded by said positioning shaft and fixed between the closed end of the electromagnet 10 and the magnetic conductor 30. A plurality of threaded holes 33 are formed in the magnetic conductor 30, so that the the magnetic conductor 30 and the electromagnet 10 can be engaged with each other by threading the screws 27 into the threaded holes 13, 33 of said electromagnet 10 and said magnetic conductor 30. The diameter of the magnetic conductor 30 is slightly smaller than the inner diameter of the cylindrical wall 21 of the rotary disk 20, so that when said magnetic conductor 30 is mounted in the electromagnet 10, the cylindrical wall 21 can be interposed between the axially projecting teeth 111 of the cylindrical wall 11 of the electromagnet 10 and the radially projecting teeth 31 of the magnetic conductor 30, but not contact therewith, as best illustrated in FIG. 2. The projecting teeth 111, 31 of the electromagnet 10 and the magnetic conductor 30 are so arranged that each of the said axially projecting teeth 111 is staggered radially with respect to each of said radially projecting teeth 31.

Figure 3:
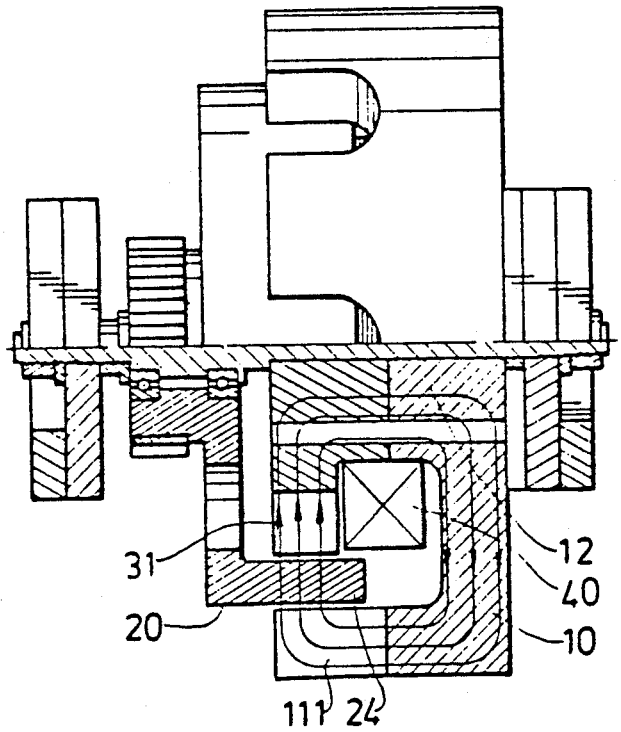
FIG. 3 is a axially sectional schematic view showing the magnetic flux path in the load applying device for an exercise bicycle of this invention.
Figure 4:
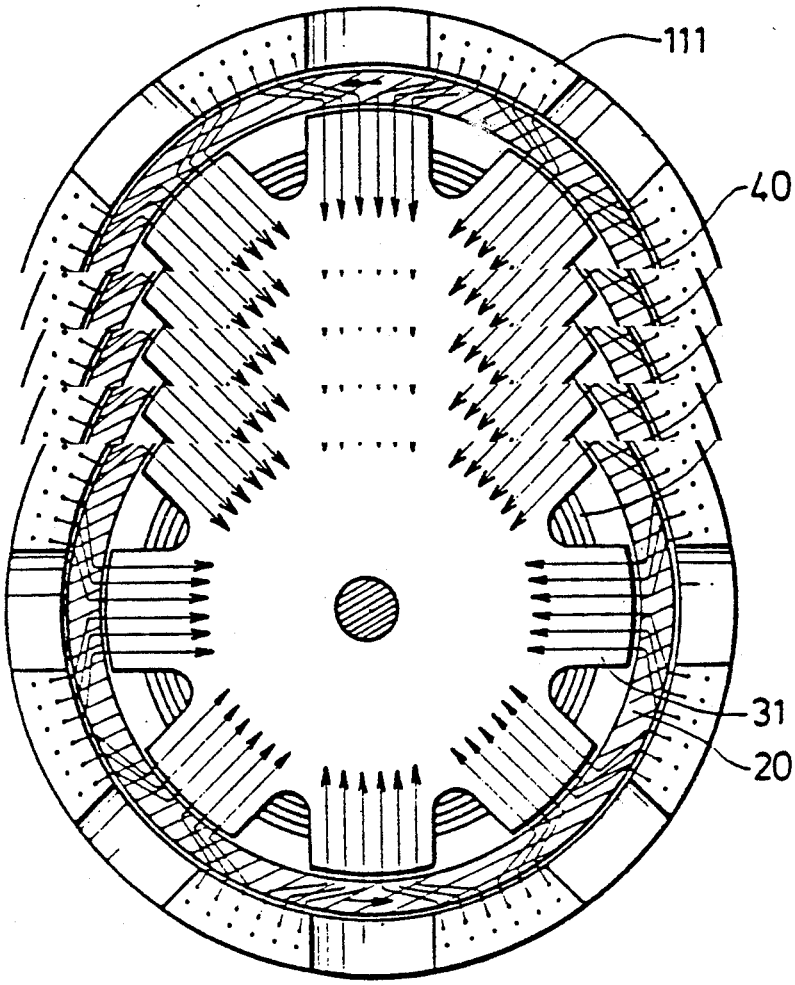
FIG. 4 is a radially sectional schematic view showing the magnetic flux path in the load applying device for an exercise bicycle of this invention.

Referring to FIGS. 3, 4, axially and radially sectional views of the magnetic flux path of the load applying device according to this invention are shown, respectively. When a DC controlling current is applied to the exciting coil 40 by means of wires (45), a magnetic field is created. The magnetic lines of force of the magnetic field flow from the central portion of the exciting coil 40 and pass through the cylinder 12 of the electromagnet 10 to the axially projecting teeth 111 of the electromagnet 10. The magnetic lines of force flowing to the axially projecting teeth 111 are divided into eight beams and pass through the cylindrical wall 21 of the rotary disk 20. Because the axially projecting teeth 111 of the electromagnet 10 and the radially projecting teeth 31 of the magnetic conductor 30 are staggered with each other in the abovementioned manner and the magnetic lines of force have the tendency of flowing in the shortest path, the eight beams of the magnetic lines of force are divided into sixteen beams and flow into the eight radially projecting teeth 31 of the magnetic conductor, and then return to the central portion of the exciting coil 40, thus forming a closed magnetic flux path. Since the magnetic lines of force pass through the cylindrical wall 21 of the rotary disk 20 by the shortest path, causing the twist of the magnetic lines of force, the beam-like magnetic flux passing through said cylindrical wall 21 can create a larger magnetic flux density, that is, the magnetic flux density is increased in the rotary disk 20.

Figure 5A:
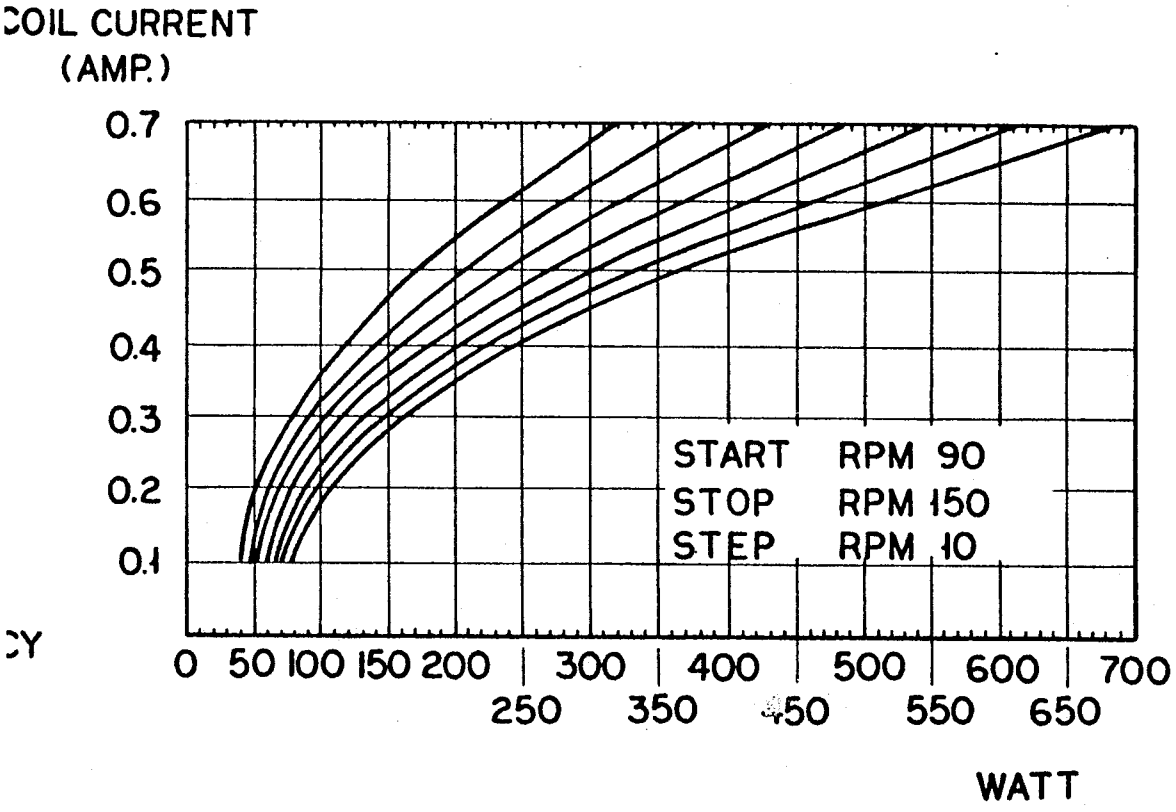
FIGS. 5 (A), 5(B) are graphs showing the experimental results obtained by utilizing the load applying device for an exercise bicycle controlled by a computer according to this invention.
Figure 5B:
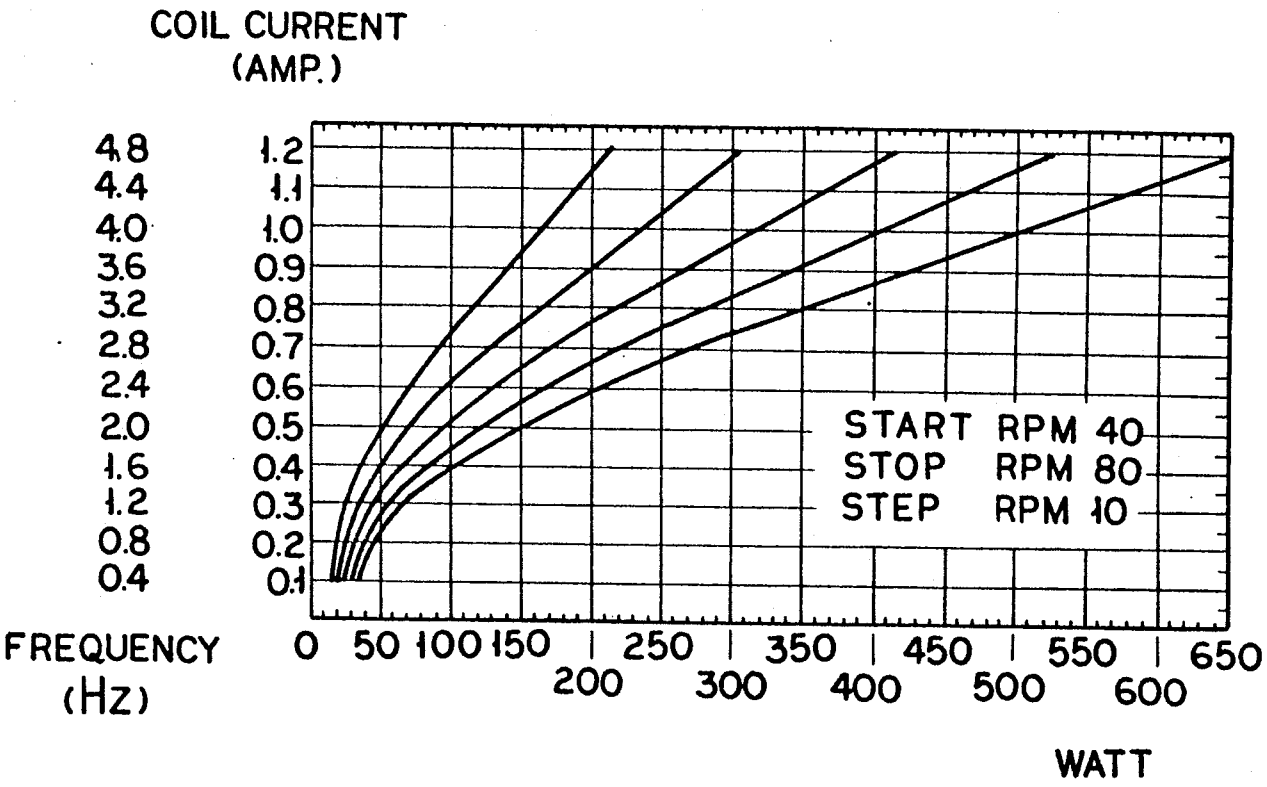

In operation, a user first selects a proper DC controlling current according to his/her physical condition and exercising quality desired. When the user pedals the exercise bicycle and rotates the transmission gear of the exercise bicycle, the spur gear 22, and thereby the rotary disk 20, is rotated by means of the belt. At the same time, the DC controlling current passes through the exciting coil 40 to create a magnetic field and enable the beam-like magnetic lines of force to pass through the cylindrical wall 21 of the rotary disk 20 in a manner as mentioned above. The magnetic lines of force will be cut by the rotating cylindrical wall 21 of the rotary disk 20, inducing in said cylindrical wall 21 an eddy current which produces a brake effect thereto. In this way, the load applying device can provide a load effect to a rotating shaft in association with the rotary disk To prove the superiority of the load applying device of this invention, said load applying device is connected to a servo motor, a torque meter and the crank shaft of the exercise bicycle and tested under the control of a computer. The resulting data are illustrated in FIGS. 5(A), 5(B), wherein the related parameters are as follows:

turns of the exciting coil: 600 gap between the cylindrical wall of the rotary disk and the axial projecting teeth of the electromagnet: 0.3 mm gap between the cylindrical wall of the rotary disk and the radially projecting teeth of the magnetic conductor: 0.3 mm inner diameter of the cylindrical wall of the rotary disk: 124 mm outer diameter of the cylindrical wall of the rotary disk: 140 mm ratio of the rotating speed of the transmission gear and the spur gear: 10

In accordance with the present invention, because the load applied to a user riding on the exercise bicycle is adjusted by means of selecting a DC controlling current to control Watts, the curvatures in the graph of coil current versus Watts is used for curvature analysis. Further, the relation between the frequency of the power supply and the controlling current, i.e., the coil current, and Watts is shown in the following formula which is obtained by numerical analysis method:

$$Hz = al*(Load - cl) + bl*\log el$$

Hz: the frequency of the power supply. The relation between Hz and the Ampere is: 4kHz = 1 Amp Load: detected Watts al, bl, cl, el: coefficients obtained by numerical analysis which are varied with the rotating speed of the pedals of the exercise bicycle (RPM1).

The relation of abovementioned coefficients and RPM1 is as follows:

$$al = 0.77281 + 28.424O93*\exp((-1)*O.546S6*RPM1)$$

$$bl = 406.432135 - 0.488126*RPM1$$

$$cl = (-1)*12.792640 + 0.757121*RPM1$$

$$0.079164 + 3.614368*\exp((-1)*0.052625*RPM1)$$

$$el = (Load - cl)*dl + 1$$

It can be seen from the curvatures in FIGS. 5(A), 5(B), that the load applying device of this invention is helpful for permitting an exercise bicycle to be controlled by a computer and planning the load to be applied to the user, based on the following reasons:

(1) The slope of each of the curvatures is more close to a constant Value, that is, more linear.

(2) When the rotating speed (RPM) is varied, the variation of the curvature is more regular.

Therefore, these curvatures can be more easily expressed or simulated with a simple formula by numerical analysis. In addition, in practical operation, the variation of the load (Watts) is more regular when the rotating speed (RPM) is varied and the coil current remains constant.

With this invention thus explained, it is apparent that numerous modifications and variations can be made without departing from the scope and spirit of this invention. It is therefore intended that this invention be limited only as indicated in the appended claims.

I claim:

1. A load applying device for applying a load to an exercise bicycle, said exercise bicycle having a rotating means operated by a user riding on said exercise bicycle, said load applying device comprising:

a fixed main shaft;

an annular exciting coil which creates a magnetic field when a DC current is applied thereto by means of a pair of wires connected thereto;

a generally cup-shaped electromagnet fixed to said main shaft serving as a first pole in said magnetic field, said electromagnet having a closed end and an open end threaded by said main shaft, a cylindrical wall axially extending from said closed end having a predetermined number of axially projecting teeth circumferentially formed at a free end thereof, and a central portion protruding from said closed end toward said open end;

a pawl-type magnetic conductor fixed to the main shaft serving as a second pole in said magnetic field, said magnetic conductor being in the form of a disk coaxially received in said electromagnet and having a predetermined number of radially projecting teeth circumferentially formed therearound, the number of said radially projecting teeth being the same as that of said axially projecting teeth, said teeth of said electromagnet being radially staggered with said teeth of said magnetic conductor, said magnetic conductor having a central portion protruding therefrom which is associated with said central portion of said electromagnet to define a positioning shaft so that said exciting coil is threaded by said positioning shaft and fixed between said closed end of said electromagnet and said magnetic conductor;

a rotor rotatably mounted to said main shaft and adapted to be rotated by the rotating means of the exercise bicycle, said rotor being a cup-shaped disk having a flat bottom portion and a cylindrical wall axially extending from said bottom portion and disposed between said first pole and second pole, but not being in contact therewith, so that said magnetic field is cut by said cylindrical wall of said rotor when said rotor is rotated by said rotating means of said exercise bicycle, creating an eddy current in said rotor for braking said rotor, whereby the rotating means is rotated by pedaling the exercise bicycle.

2. A load applying device as claimed in claim 1, wherein said central portions of said electromagnet and said magnetic conductor are cylinders with a same diameter.

3. A load applying device as claimed in claim 1, wherein said rotor has a spur gear fixed to said bottom portion, which is connected to said rotating means of said exercise bicycle so that said rotor can be rotated by said rotating means of said exercise bicycle.

* * * * *